US006915257B2

(12) United States Patent
Heikkinen et al.

(10) Patent No.: US 6,915,257 B2
(45) Date of Patent: Jul. 5, 2005

(54) METHOD AND APPARATUS FOR SPEECH CODING WITH VOICED/UNVOICED DETERMINATION

(75) Inventors: Ari Heikkinen, Tampere (FI); Samuli Pietila, Tampere (FI); Vesa Ruoppila, Ville Mont-Royal (CA)

(73) Assignee: Nokia Mobile Phones Limited, Espoo (FI)

( * ) Notice: Subject to any disclaimer, the term of this patent is extended or adjusted under 35 U.S.C. 154(b) by 540 days.

(21) Appl. No.: 09/740,826

(22) Filed: Dec. 21, 2000

(65) Prior Publication Data

US 2002/0156620 A1 Oct. 24, 2002

(30) Foreign Application Priority Data

Dec. 24, 1999 (GB) ..... 9930712

(51) Int. Cl.[7] ..... G10L 11/06; G10L 11/04

(52) U.S. Cl. ..... 704/214; 704/206; 704/207; 704/208

(58) Field of Search ..... 704/206, 207, 704/208, 214, 220, 223, 268

(56) References Cited

U.S. PATENT DOCUMENTS

| | | | | |
|---|---|---|---|---|
| 4,074,069 | A | 2/1978 | Tokura et al. | |
| 4,230,906 | A | 10/1980 | Davis | |
| 4,589,131 | A | 5/1986 | Horvath et al. | |
| 5,734,789 | A | 3/1998 | Swaminathan et al. | |
| 6,219,636 | B1 * | 4/2001 | Ihara | 704/207 |

FOREIGN PATENT DOCUMENTS

| | | |
|---|---|---|
| DE | 2334459 | 1/1975 |
| DE | 23 34 459 | 1/1975 |
| FR | WO 96/21220 | 7/1996 |
| WO | 98/01848 | 1/1998 |

OTHER PUBLICATIONS

Rabiner et al., "Digital Processing of Speech Signals," 1978, Prentice–Hall, Inc, pp. 158–162.*

Hess, W., "Pitch and voicing determination," in Advances in Speech Signal Processing, (1992) S. Furui & M. Sondhi (eds.), Marcel Dekker, New York, pp. 3–48.*

Rabiner et al. "Applications of Nonlinear Smoothing Algorithm to Speech Processing," in IEEE Transactions on Acoustics, Speech, and Signal Processing, vol. ASSP–23, No. 6, Dec. 1975, pp. 552–557.*

Siegel et al. "Voiced/Unvoiced/Mixed Excitation Classification of Speech," in IEEE Transactions on Acoustics, Speech, and Signal Processing, vol. ASSP–30, No. 3, Jun. 1982, pp. 451–460.*

* cited by examiner

*Primary Examiner*—Richemond Dorvil
*Assistant Examiner*—V. Paul Harper
(74) *Attorney, Agent, or Firm*—Antonelli, Terry, Stout & Kraus, LLP

(57) ABSTRACT

This invention presents a voicing determination algorithm for classification of a speech signal segment as voiced or unvoiced. The algorithm is based on a normalized autocorrelation where the length of the window is proportional to the pitch period. The speech segment to be classified is further divided into a number of sub-segments, and the normalized autocorrelation is calculated for each sub-segment if a certain number of the normalized autocorrelation values is above a predetermined threshold, the speech segment is classified as voiced. To improve the performance of the voicing determination algorithm in unvoiced to voiced transients, the normalized autocorrelations of the last sub-segments are emphasized. The performance of the voicing decision algorithm can be enhanced by utilizing also the possible lookahead information.

28 Claims, 4 Drawing Sheets

METHOD AND APPARATUS FOR SPEECH CODING WITH VOICED/UNVOICED DETERMINATION

BACKGROUND OF THE INVENTION

1. Field of the Invention

The present invention relates to speech processing, and more particularly to a voicing determination of the speech signal having a particular, but not exclusive, application to the field of mobile telephones.

2. Description of the Prior Art

In known speech codecs the most common phonetic classification is a voicing decision, which classifies a speech frame as voiced or unvoiced. Generally speaking, voiced segments are typically associated with high local energy and exhibit a distinct periodicity corresponding to the fundamental frequency, or equivalently pitch, of the speech signal, whereas unvoiced segments resemble noise. However, a speech signal also contains segments, which can be classified as a mixture of voiced and unvoiced speech where both components are present simultaneously. This category includes voiced fricatives and breathy and creaky voices. The appropriate classification of mixed segments as either voiced or unvoiced depends on the properties of the speech codec.

In a typical known analysis-by-synthesis (A-b-S) based speech codec, the periodicity of speech is modelled with a pitch predictor filter, also referred to as a long-term prediction (LTP) filter. It characterizes the harmonic structure of the spectrum based on the similarity of adjacent pitch periods in a speech signal. The most common method used for pitch extraction is the autocorrelation analysis, which indicates the similarity between the present and delayed speech segments. In this approach the lag value corresponding to the major peak of the autocorrelation function is interpreted as the pitch period. It is typical that for voiced speech segments with a clear pitch period the voicing determination is closely related to pitch extraction.

SUMMARY OF THE INVENTION

According to a first aspect of the present invention there is provided a method for determining the voicing of a speech signal segment, comprising the steps of: dividing a speech signal segment into sub-segments, determining a value relating to the voicing of respective speech signal sub-segments, comparing said values with a predetermined threshold, and making a decision on the voicing of the speech segment based on the number of the values on one side of the threshold.

According to a second aspect of the present invention there is provided a device for determining the voicing of a speech signal segment, comprising means (106) for dividing a speech signal segment into sub-segments, means (110) for determining a value relating to the voicing of respective speech signal sub-segments, means (112) for comparing said values with a predetermined threshold and means (112) for making a decision on the voicing of the speech segment based on the number of the values on one side of the threshold.

The invention provides a method for voicing determination to be used particularly, but not exclusively, in a narrowband speech coding system. The invention addresses the problems of prior art by determining the voicing of the speech segment based on the periodicity of its sub-segments The embodiments of the present invention give an improvement in the operation in a situation where the properties of the speech signal vary rapidly such that the single parameter set computed over a long window does not provide a reliable basis for voicing determination.

A preferred embodiment of the voicing determination of the present Invention divides a segment of speech signal further into sub-segments. Typically the speech signal segment comprises one speech frame. Furthermore, it may optionally include a possible lookahead which is a certain portion of the speech signal from the next speech frame. A normalized autocorrelation is computed for each sub-segment. The normalized autocorrelation values of the sub-segments are forwarded to classification logic, which compares the sub-segments to the predefined threshold value. In this embodiment, if a certain percentage of normalized autocorrelation values exceeds a threshold, the segment is classified as voiced.

In one embodiment of the present invention, a normalized autocorrelation is computed for each sub-segment using a window whose length is proportional to the estimated pitch period. This ensures that a suitable number of pitch periods is included to the window.

In addition to the above, a critical design problem in voicing determination algorithms is the correct classification of transient frames. This is especially true in transients from unvoiced to voiced speech as the energy of the speech signal is usually growing. if no separate algorithm is designed for classifying the transient frames, the voicing determination algorithm is always a compromise between the misclassification rate and the sensitivity to detecting transient frames appropriately.

To improve the performance of the voicing determination algorithm during transient frames without increasing the misclassification rate practically at all, one embodiment of the present invention provides rules for classifying the speech frame as voiced. This is done by emphasizing the voicing decisions of the last sub-segments in a frame to detect the transients from unvoiced to voiced speech. That is, in addition to having a certain number of sub-segments having a normalized autocorrelation value exceeding a threshold value, the frame is classified as voiced also if all of a predetermined number of the last sub-segments have a normalized autocorrelation value exceeding the same threshold value. Detection of unvoiced to voiced transients is thus further improved by emphasizing the last sub-segments in the classification logic.

The frame may be classified as voiced if only the last sub-segment has a normalized autocorrelation value exceeding the threshold value.

Alternatively, the frame may be classified as voiced if a portion of the subsegments out of the whole speech frame have a normalized autocorrelation value exceeding the threshold, The portion may, for example be substantially a half, or substantially a third of the sub-segments of the speech frame.

The voiced/unvoiced decision can be used for two purposes. One option is to allocate bits within the speech codec differently for voiced and unvoiced frames. In general, voiced speech segments are perceptually more important than unvoiced segments and thus it is especially important that a speech frame is correctly classified as voiced. In the case of A-b-S type of codec, this can be done for example by re-allocating bits from the adaptive codebook (for example from LTP-gain and LTP-lag parameters) to the excitation signal when the speech frame is classified as unvoiced to improve the coding of the excitation signal. On the other hand the adaptive codebook in a speech codec can then be even switched off during the unvoiced speech frame which will lead to reduced total bit rate. Because of this on/off switching of LTP-parameters it is especially important that a speech frame is correctly classified as voiced. It has been noticed that, if a voiced speech frame is incorrectly classified as unvoiced and the LTP parameters are switched off, this leads to a decreased sound quality at the receiving end. Accordingly, the present invention provides a method and device for a voiced/unvoiced decision to make a reliable decision, especially, so that voiced speech frames are not incorrectly decided as unvoiced.

BRIEF DESCRIPTION OF THE DRAWINGS

Exemplary embodiments of the invention are hereinafter described with the reference to the accompanying drawings, in which.

DETAILED DESCRIPTION OF THE DRAWINGS

Figure 1:
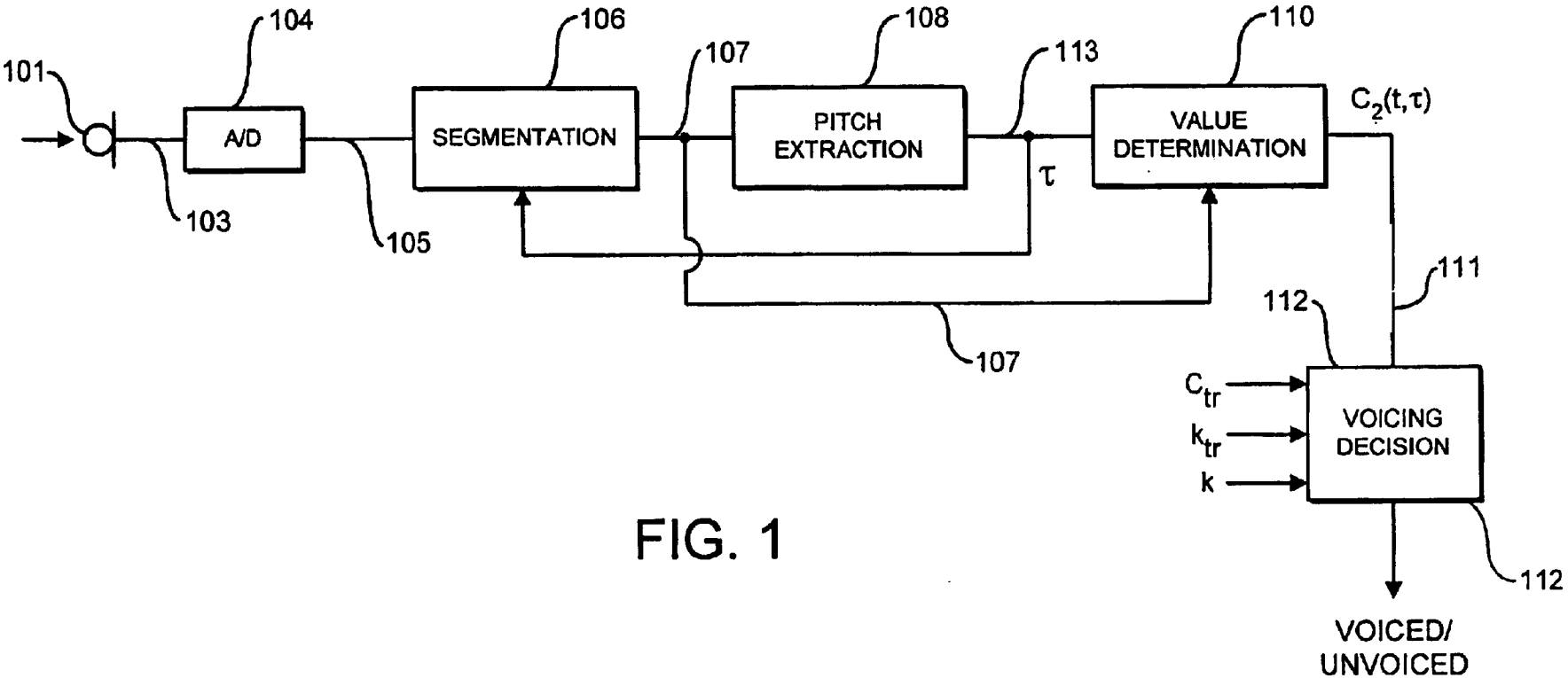
FIG. 1 shows a block diagram of an apparatus of the present invention.

FIG. 1 shows a device 1 for voicing determination according to the first embodiment of the present invention. The device comprises a microphone 101 for receiving an acoustical signal 102, typically a voice signal, generated by a user, and converting it into an analog electrical signal at line 103. An AID converter 104 receives the analog electrical signal at line 103 and produces a digital electrical signal y(t) of the user's voice at line 105. A segmentation block 106 then divides speech signal to predefined sub-segments at line 107. A frame of 20 ms (160 samples) can for example divided into 4 sub-segments of 5 ms. After segmentation a pitch extraction block 108 extracts the optimum open-loop pitch period for each speech sub-segment The optimum open-loop pitch is estimated by minimizing the sum-squared error between the speech segment and its delayed and gain-scaled version as following:

$$J(t, \tau, g(t)) = \sum_{i=0}^{N-1} (y(t+i) - g(t)y(t+i-\tau))^2 \tag{1}$$

where y(t) is the first speech sample belonging to the window of length N, τ is the integer pitch period and g(t) is the gain.

The optimum value of g(t) is found by setting the partial derivative of the cost function (1) with respect to the gain equal to zero. This yields $$g(t) = \frac{R(t, \tau)}{R(t-\tau)} \tag{2}$$

where $$R(t, \tau) = \sum_{i=0}^{N-1} y(t+i)y(t+i-\tau) \tag{3}$$

is the autocorrelation of y(t) with delay τ and $$R(t) = R(t, 0) = \sum_{i=0}^{N-1} y^2(t+i) \tag{4}$$

Figure 2:
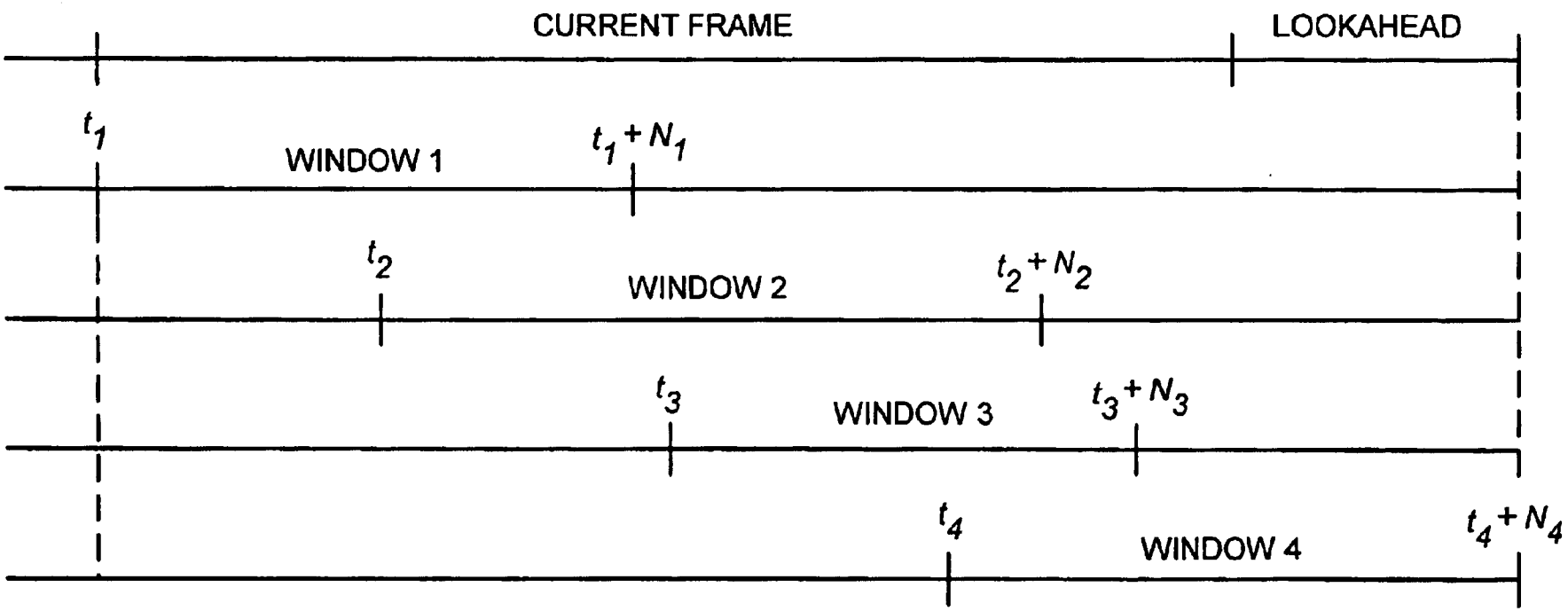
FIG. 2 shows a speech signal framing of the present invention.

By substituting the optimum gain to equation (1), the pitch period is estimated by maximizing the latter term of $$J(t, \tau) = R(t) - \frac{R^2(t, \tau)}{R(t-\tau)} \tag{5}$$

with respect to delay τ. The pitch extraction block 108 is also arranged to send the above determined estimated open-loop pitch estimate τ at line 113 to the segmentation block 106 and to a value determination block 110. An example of the operation of the segmentation is shown in FIG. 2, which is described later.

The value determination block 110 also receives the speech signal y(t) from the segmentation block 106 at line 107. The value determination block 110 is arranged to operate as follows:

To eliminate the effects of the negative values of the autocorrelation function when maximizing the function, a square root of the latter term of equation (5) is taken. The term to be maximized is thus:

$$C_0(t, \tau) = R(t, \tau) \Big/ \sqrt{R(t-\tau)} \tag{6}$$

During voiced segments, the gain g(t) tends to be near unity and thus it is often used for voicing determination. However, during unvoiced and transient regions, the gain g(t) fluctuates achieving also values near unity. A more robust voicing determination is achieved by observing the values of equation (6). To cope with the power variations of the signal, R(t,τ) is normalized to have a maximum value of unity resulting:

$$C_1(t, \tau) = \frac{R(t, \tau)}{\sqrt{R(t)\sqrt{R(t-\tau)}}} \tag{7}$$

According to one aspect of the invention, the window length in (7) is set to the found pitch period τ plus some offset M to overcome the problems related to a fixed-length window. The periodicity measure used is thus $$C_2(t, \tau) = \frac{R_w(t, \tau)}{\sqrt{R_w(t)\sqrt{R_w(t-\tau)}}} \tag{8}$$

where $$R_w(t, \tau) = \sum_{i=0}^{r+M-1} y(t+i)y(t=i-\tau) \text{ and} \tag{9}$$

-continued $$R_w(t) = R_w(t, 0) = \sum_{i=0}^{t+M-1} \bar{y}^2(t+i) \tag{10}$$

The parameter M can be set, e.g. to 10 samples. A voicing decision block 112 is to receive the above determined periodicity measure $C_2(t, \tau)$ at line 111 from the value determination block 110 and parameters K, $K_{tr}$, $C_{tr}$ to make the voicing decision. The decision logic of voiced/unvoiced decision is further described in FIG. 3 below.

It should be emphasized that the pitch period used in (8) can also be estimated in other ways than described in equations (1)–(6) above. A common modification is to use pitch tracking in order to avoid pitch multiples described in a Finnish patent application FI 971976. Another optional function for the open-loop pitch extraction is that the effect of the formant frequencies is removed from the speech signal before pitch extraction. This can be done for example by a weighting filter.

Modified signals for example a residual signal, weighted residual signal or weighted speech signal, can also be used for voicing determination instead of the original speech signal. The residual signal is obtained by filtering the original speech signal by a linear prediction analysis filter.

It may also be advantageous to estimate the pitch period from the residual signal of the linear prediction filter instead of the speech signal, because the residual signal is often more clearly periodic.

The residual signal can be further low-pass filtered and down-sampled before the above procedure. Down-sampling reduces the complexity of correlation computation. In one further example, the speech signal is first filtered by a weighting filter before the calculation of autocorrelation is applied as described above.

FIG. 2 shows an example of dividing a speech frame into four sub-segments whose starting positions are t1, t2, t3 and t4. The window lengths N1, N2, N3 and N4 are proportional to the pitch period found as described above. The lookahead is also utilized in the segmentation. In this example, the number of sub-segments is fixed. Alternatively the number of subsegments can variable based on the pitch period. This can be done for example by selecting the subsegments by t2=t1+τ+L, t3=t2+τ+L, etc. until all available data is utilized. In this example L is constant and can be set e.g. −10 resulting overlapping sub-segments.

Figure 3:
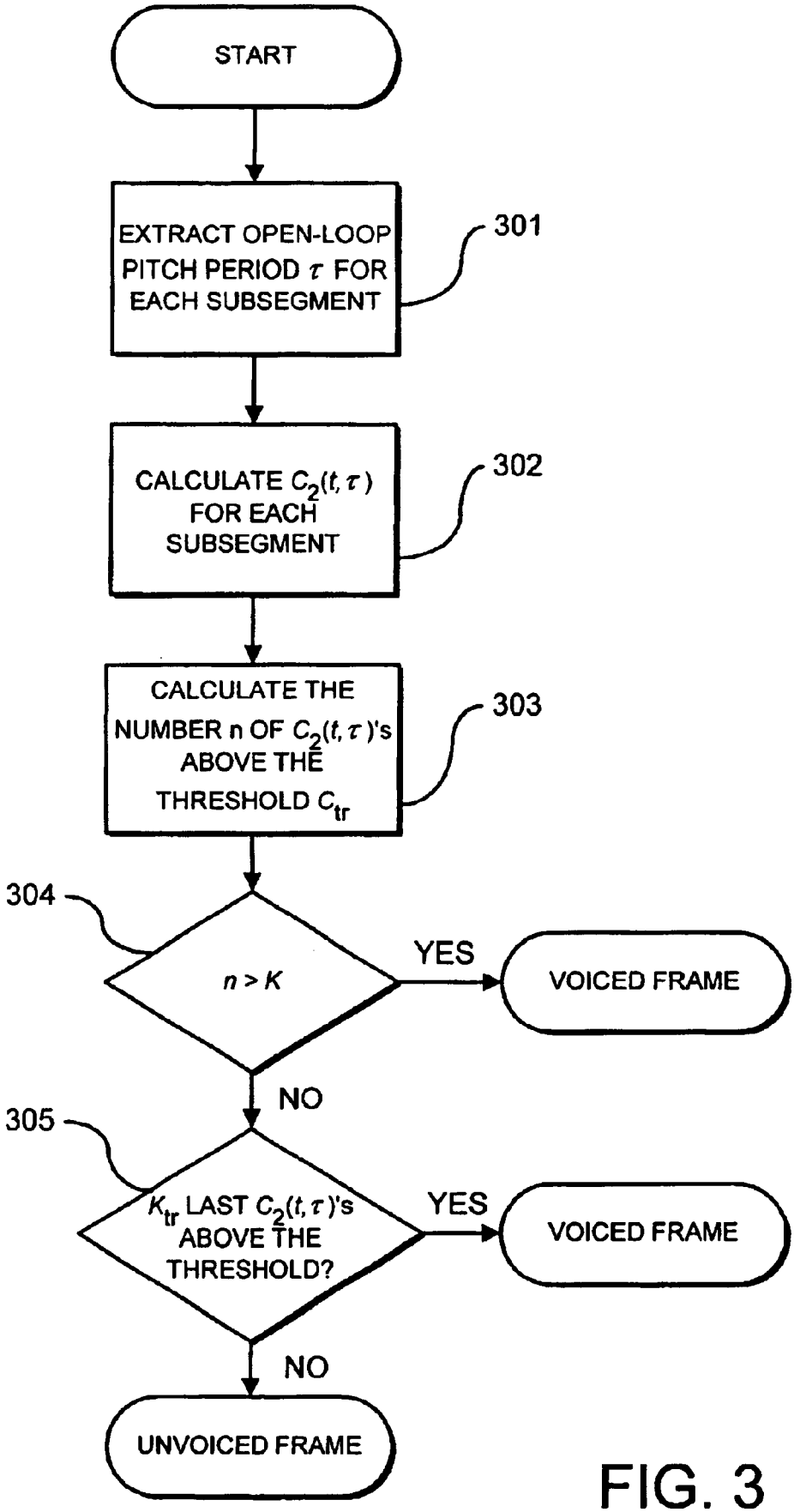
FIG. 3 shows a flow diagram in accordance with the present invention.

FIG. 3 shows a flow diagram of the method according to one embodiment of the present invention. The procedure is started by step 301 where the open-loop pitch period ~r is extracted as exemplified above in equations (1)–(6). At step 302 $C_2(t, \tau)$ is calculated for each sub-segment of the speech as described in equation (8). Next at step 303, the number of sub-segments n is calculated where $C_2(t, \tau)$ is above a certain first threshold value $C_{tr}$. The comparator 304 determines whether the number of sub-segments n, determined at step 303, exceeds a certain second threshold value K. If the second threshold value K is exceeded the speech frame is classified as voiced. Otherwise the procedure continues to step 305. In this embodiment, at step 305 the comparator determines if a certain number $K_{tr}$ of last subsegments have a value $C_2(t, \tau)$ exceeding the threshold $C_{tr}$. If the threshold is exceeded the speech frame is classified as a voiced frame. Otherwise the speech frame is classified as unvoiced frame.

The exact parameter values $C_{tr}$, $K_{tr}$ and K presented above are not limited to certain values but are dependent on the system specified and can be selected empirically using a large speech database. For example, if the speech segment is divided into 9 subsegments, suitable values can be for example $C_{tr}$,=0.6, $K_{tr}$=4 and K=6. An appropriate value of K and $K_{tr}$ is proportional to the number of sub-segments.

Alternatively, according to the present invention, the frame is classified as voiced if only the last sub-segment (i.e. $K_{tr}$=1) has a normalized autocorrelation value exceeding the threshold value. According to still one modification the frame is classified as voiced if substantially half of the sub-segments out of the whole speech frame (e.g. 4 or 5 subsegments out of 9) have a normalized autocorrelation value exceeding the threshold.

Figure 4:
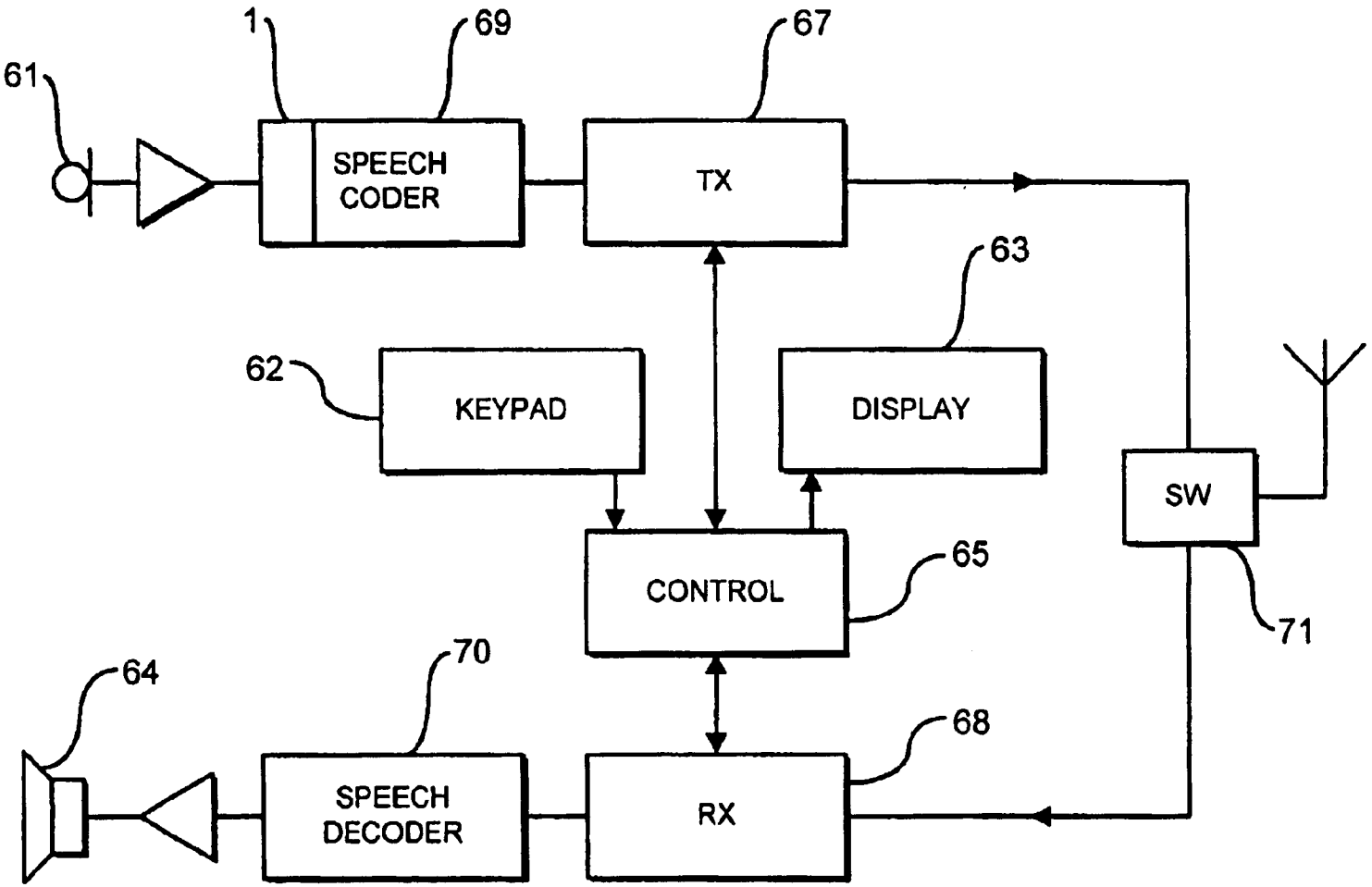
FIG. 4 shows a block diagram of a radiotelephone utilizing the invention.

FIG. 4 is a block figure of a radiotelephone including the parts of the present invention. The radiotelephone comprises of a microphone 61, keypad 62, display 63, speaker 64 and antenna 71 with switch for duplex operation. Further included is a control unit 65, implemented for example in an ASIC circuit, for controlling the operation of the radiotelephone. FIG. 4 also shows the transmission and reception blocks 67, 68 including speech encoder and decoder blocks 69, 70. The device for voicing determination 1 is preferably included within the speech encoder 69. Alternatively the voicing determination can be implemented separately, not within the speech encoder 89. The speech encoder/decoder blocks 69, 70 and the voicing determination 1 can be implemented by a DSP circuit including known elements such as internal/external memories and registers, for implementing the present invention. The speech encoder/decoder can be based on any standard/technology and the present invention thus forms one part for the operation of such codec. The radiotelephone itself can operate in any existing or future telecommunication standard based on digital technology.

To improve the performance of the voicing determination algorithm, the last sub-segments are emphasized and specifically the performance of the voicing determination algorithm in unvoiced to voiced transients is emphasized including if all of a predetermined number of the last sub-segments have a normalized authorization value exceeding the same threshold value.

In the view of foregoing description it will be evident to a person skilled in the art that various modifications may be made within the scope of the present invention.

What is claimed is:

1. A method for determining the voicing of a speech signal segment, comprising the steps of: dividing a speech signal segment into sub-segments, determining a value relating to the voicing of respective speech signal sub-segments, comparing said values with a predetermined threshold, and making a decision on the voicing of the speech segment based on the number of the values on one side of the threshold and with emphasis on at least one last sub-segment of the segment.

2. A method of claim 1, wherein said step of making a decision is based on whether the value relating to the voicing of the last sub-segment is on the one side of the threshold.

3. A method of claim 1, wherein said step of making a decision is based on whether the values relating to the voicing of last $K_{tr}$ sub-segments are on the one side of the threshold.

4. A method of claim 1, wherein said step of making a decision is based on whether the values relating to the voicing of substantially half of the sub-segments of the speech signal segment are on the one side of the threshold.

5. A method of claim 1, wherein said value related to voicing of respective speech signal sub-segments comprises an autocorrelation value.

6. A method of claim 5, wherein a pitch period is determined based on said autocorrelation value.

7. A method of claim 1, wherein the determining the voicing of a speech signal segment comprises a voiced/unvoiced decision.

8. A device for determining the voicing of a speech signal segment, comprising:

means for dividing a speech signal segment into subsegments;

means for determining a value relating to the voicing of respective speech signal sub-segments;

means for comparing said values with a predetermined threshold; and means for making a decision on the voicing of the speech segment based on the number of the values falling on one side of the threshold and with emphasis on at least one last subsegment of the segment.

9. A device of claim 8, wherein said means for making a decision comprises means for determining if the value of the last sub-segment is on the one side of the threshold.

10. A device of claim 9, wherein said means for making a decision comprises:

means for determining whether the values relating to the voicing of substantially half of the sub-segments the speech signal segment are on the one side of the threshold.

11. A device of claim 8, wherein said means for making decision comprises means for determining if the values of last $K_{tr}$, sub-segments are on the one side of the threshold.

12. A device of claim 11, wherein said means for making a decision comprises:

means for determining whether the values relating to the voicing of substantially half of the sub-segments the speech signal segment are on the one side of the threshold.

13. A device of claim 8, wherein said means for making a decision comprises means for determining whether the values relating to the voicing of substantially half of the sub-segments the speech signal segment are on the one side of the threshold.

14. A device of claim 8, wherein the said means for determining a value relating to the voicing of respective speech signal sub-segments comprises means for determining the autocorrelation value.

15. A method for determining the voicing of a speech signal segment, comprising the steps of: dividing a speech signal segment into sub-segments, determining a value relating to the voicing of respective speech signal sub-segments, comparing said values with a predetermined threshold, and making a decision on the voicing of the speech segment based on the number of the values on one side of the threshold and with emphasis on at least one last subsegment of the segment being used in the detection of unvoiced to voiced speech.

16. A method of claim 15, wherein said step of making a decision is based on whether the value relating to the voicing of the last sub-segment is on the one side of the threshold.

17. A method of claim 15, wherein said step of making a decision is based on whether the values relating to the voicing of last $K_{tr}$ sub-segments are on the one side of the threshold.

18. A method of claim 15, wherein said step of making a decision is based on whether the values relating to the voicing of substantially half of the sub-segments of the speech signal segment are on the one side of the threshold.

19. A method of claim 15, wherein said value related to voicing of respective speech signal sub-segments comprises an autocorrelation value.

20. A method of claim 19, wherein a pitch period is determined based on said autocorrelation value.

21. A method of claim 15, wherein the determining the voicing of a speech signal segment comprises a voiced/unvoiced decision.

22. A device for determining the voicing of a speech signal segment, comprising:

means for dividing a speech signal segment into subsegments;

means for determining a value relating to the voicing of respective speech signal sub-segments;

means for comparing said values with a predetermined threshold; and means for making a decision on the voicing of the speech segment based on the number of the values falling on one side of the threshold and with emphasis on at least one last subsegment of the segment being used in the detection of unvoiced to voiced speech.

23. A device of claim 22, wherein said means for making a decision comprises means for determining if the value of the last sub-segment is on the one side of the threshold.

24. A device of claim 23, wherein said means for making a decision comprises:

means for determining whether the values relating to the voicing of substantially half of the sub-segments the speech signal segment are on the one side of the threshold.

25. A device of claim 36, wherein said means for making decision comprises means for determining if the values of last $K_{tr}$, sub-segments are on the one side of the threshold.

26. A device of claim 22, wherein said means for making a decision comprises means for determining whether the values relating to the voicing of substantially half of the sub-segments the speech signal segment are on the one side of the threshold.

27. A device of claim 22, wherein the said means for determining a value relating to the voicing of respective speech signal sub-segments comprises means for determining the autocorrelation value.

28. A device of claim 22, wherein said means for making a decision comprises:

means for determining whether the values relating to the voicing of substantially half of the sub-segments the speech signal segment are on the one side of the threshold.

* * * * *